US010093873B2

(12) United States Patent
Koseoglu et al.

(10) Patent No.: US 10,093,873 B2
(45) Date of Patent: Oct. 9, 2018

(54) PROCESS TO RECOVER GASOLINE AND DIESEL FROM AROMATIC COMPLEX BOTTOMS

(71) Applicant: Saudi Arabian Oil Company, Dharan (SA)

(72) Inventors: Omer Refa Koseoglu, Dhahran (SA); Robert Peter Hodgkins, Dhahran (SA); Bruce Richard Beadle, Dhahran (SA); Vinod Ramaseshan, Ras Tanura (SA); Rakan Sulaiman Bilaus, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 135 days.

(21) Appl. No.: 15/257,619

(22) Filed: Sep. 6, 2016

(65) Prior Publication Data

US 2018/0066197 A1 Mar. 8, 2018

(51) Int. Cl.

| | |
|---|---|
| ***C10G 35/00*** | (2006.01) |
| ***C10G 45/02*** | (2006.01) |
| ***C10G 45/44*** | (2006.01) |
| ***C10G 63/02*** | (2006.01) |
| ***C10G 69/08*** | (2006.01) |
| ***C10G 69/00*** | (2006.01) |

(52) U.S. Cl.

CPC ..... *C10G 69/08* (2013.01); *C10G 69/00* (2013.01); *C10G 2300/1044* (2013.01); *C10G 2300/1055* (2013.01); *C10G 2300/1096* (2013.01); *C10G 2400/02* (2013.01)

(58) Field of Classification Search

CPC ..... C10G 35/00; C10G 45/02; C10G 45/44; C10G 63/02; C10G 69/08; C10G 2400/02; C10G 2400/04; B01J 2219/00006

See application file for complete search history.

(56) References Cited

U.S. PATENT DOCUMENTS

| | | | | |
|---|---|---|---|---|
| 3,159,565 | A | 12/1964 | Kimberlin et al. | |
| 3,252,888 | A | 5/1966 | Langer, Jr. | |
| 3,595,933 | A | 7/1971 | Feldman | |
| 3,624,172 | A | 11/1971 | Adams | |
| 3,649,520 | A | 3/1972 | Graven | |
| 3,702,292 | A | 11/1972 | Burich | |
| 3,723,256 | A | 3/1973 | Thompson | |
| 3,795,608 | A | 3/1974 | Fujiyama | |
| 3,933,619 | A | 1/1976 | Kozlowski | |
| 3,939,221 | A | 2/1976 | Pearce | |
| 4,070,408 | A | 1/1978 | Vickers | |
| 4,203,826 | A | 5/1980 | Mayes | |
| 4,222,854 | A | 9/1980 | Vorhis, Jr. et al. | |
| 4,747,933 | A | 5/1988 | Hibbs | |
| 4,923,589 | A | 5/1990 | Dalson | |
| 5,877,385 | A | 3/1999 | Lee | |
| 6,281,398 | B1 | 8/2001 | Belloir et al. | |
| 6,375,802 | B1 | 4/2002 | Gentry | |
| 6,398,947 | B2 | 6/2002 | Beck | |
| 6,565,742 | B1 | 5/2003 | Gentry | |
| 6,616,831 | B1 | 9/2003 | Gentry | |
| 6,787,025 | B2 | 9/2004 | Mukherjee et al. | |
| 6,793,804 | B1 | 9/2004 | Lindsay et al. | |
| 7,507,325 | B2 | 3/2009 | Gueret et al. | |
| 8,536,397 | B2 | 9/2013 | Noll | |
| 8,932,451 | B2 * | 1/2015 | Strauss | C10G 45/00 208/309 |
| 8,975,462 | B2 | 3/2015 | Kim | |
| 9,090,521 | B2 | 7/2015 | Al-Haji | |
| 9,109,169 | B2 | 8/2015 | Al-Therwi | |
| 9,221,729 | B1 | 12/2015 | Lee | |
| 9,909,075 | B2 * | 3/2018 | Klein | C10G 55/04 |
| 2001/0001448 | A1 | 5/2001 | Kapoor | |
| 2013/0144097 | A1 | 6/2013 | Bender | |
| 2013/0345486 | A1 | 12/2013 | Noll | |
| 2015/0166435 | A1 | 6/2015 | Serban et al. | |
| 2015/0251973 | A1 | 9/2015 | Tinger | |
| 2015/0299086 | A1 | 10/2015 | Farha | |
| 2016/0045841 | A1 | 2/2016 | Kaplan | |

FOREIGN PATENT DOCUMENTS

| | | | |
|---|---|---|---|
| CN | 101376823 | A | 3/2009 |
| CN | 102037102 | A | 4/2011 |
| GB | 1279218 | A | 6/1972 |
| GB | 1404776 | A | 9/1975 |
| GB | 2034351 | A | 6/1980 |
| JP | 3639243 | B2 | 4/2005 |
| WO | 9617039 | A1 | 6/1996 |
| WO | 9923192 | A1 | 5/1999 |

OTHER PUBLICATIONS

International Search Report and Written Opinion for related PCT application PCT/US2017/047842 dated Oct. 11, 2017.

Coco et al., "Multidimensional gas chromatographic determination of paraffins, olefins and aromatics in naphthas", Annali Di Chimica, EUCHEM 2006 Conference, Rimini Italy, 2006, p. 1.

Hu et al., "Molecular modeling and optimization for catalytic reforming", Chemical Engineering Communications, 2004, p. 1.

Liu et al., "A scenario-based clean gasoline production strategy for china national petroleum corporation", Petroleum Science, 2008, p. 1.

(Continued)

*Primary Examiner* — Randy Boyer

(74) *Attorney, Agent, or Firm* — Bracewell LLP; Constance G. Rhebergen; Kevin R. Tamm

(57) ABSTRACT

Systems and methods are disclosed for crude oil separation and upgrading, which include the ability to reduce aromatic complex bottoms content in gasoline and higher-quality aromatic compounds. In some embodiments, aromatic complex bottoms are recycled for further processing. In some embodiments, aromatic complex bottoms are separated for further processing.

8 Claims, 7 Drawing Sheets

(56) References Cited

OTHER PUBLICATIONS

Nafis et al., "Recovering Intermediate-Range FCC Naphtha", Handbook of Petroleum Refining Processes Third Edition, 2004, pp. 11.72-11.78, McGraw Hill, USA.

PCT International Search Report and the Written Opinion of the International Searching Authority dated Nov. 28, 2013; International Application No. PCT/US2013/039191 (SA5043/PCT); pp. 1-18.

PCT Notification of Transmittal of the Partial International Search Report of the International Searching Authority, dated Jul. 4, 2013; International Application No. PCT/US2013/039191 (SA5043/PCT); pp. 1-7.

Viswanadham et al., "Reformulation of FCC gasoline" Fuel, Mexican Congress on Chemical Reaction Engineering, Mexico City, Mexico Inst. Mexicano Petroleo, Jun. 2007, p. 1.

* cited by examiner

PROCESS TO RECOVER GASOLINE AND DIESEL FROM AROMATIC COMPLEX BOTTOMS

BACKGROUND

Field

Embodiments of the disclosure relate to separation systems and processes for hydrocarbon fluids. In particular, certain embodiments of the disclosure relate to systems and processes for recovering gasoline and diesel from aromatic complex bottoms.

Description of the Related Art

Catalytic reformers are used in refineries to produce reformate, which itself is used as an aromatic rich gasoline blending fraction, or is used as feedstock to produce aromatics, also referred to as benzene, toluene, and xylene (BTX). Due to stringent fuel specifications implemented or being implemented worldwide, for example requiring less than 35 volume % (V %) aromatics and less than 1 V % benzene in gasoline, the reformate fraction is further treated to reduce its aromatics content. Treatment options available include benzene hydrogenation and aromatics extraction. In benzene hydrogenation, the reformate is selectively hydrogenated to reduce the benzene content, and the total aromatics content is reduced by blending if needed. In aromatics extraction, the reformate is sent to an aromatic complex to extract the aromatics, such as benzene, toluene and xylenes, which have a premium chemical value, and to produce an aromatics and benzene free gasoline blending component. The aromatic complex produces a reject stream or bottoms stream that is very heavy (boiling in the range of about 100-350° C.), which is not suitable as a gasoline blending component.

Refinery products used for fuels are receiving increasing levels of attention. Product specifications are being scrutinized by governmental agencies whose interests include decreased emissions from mobile and stationary sources, and by the industries that produce the engines and vehicles that utilize these fuels. Regional and national regulations have been in place and continue to evolve concerning gasoline specifications, and automakers have proposed a set of limitations for gasoline and diesel to allow them to manufacture vehicles which will produce significantly lower emissions over their lifetime. Maximum sulfur, aromatics, and benzene levels of about 10 ppmw, 35 V %, and 1 V % or less, respectively, have been targeted as goals by regulators.

Historically, lead was commonly added to gasoline to increase octane. When the use of lead was phased out due to environmental concerns, no direct substitute existed, and refiners instead have converted certain hydrocarbon molecules used in gasoline blending in order to achieve higher octane ratings. Catalytic reforming, which involves a variety of reactions in the presence of one or more catalysts and recycle and make-up hydrogen, is a widely used process for refining hydrocarbon mixtures to increase the yield of higher octane gasoline.

Although benzene yields can be as high as 10 V % in reformates, no more than about 3 V % can be present in typical gasoline pools. There currently exist methods to remove benzene from reformate, including separation processes and hydrogenation reaction processes. In separation processes, benzene is extracted with a solvent and then separated from the solvent in a membrane separation unit or other suitable unit operation. In hydrogenation reaction processes, the reformate is divided into fractions to concentrate the benzene, and then one or more benzene-rich fractions are hydrogenated.

In some refineries, naphtha is reformed after hydrodesulfurization to increase the octane content of the gasoline. Reformate contains a high level of benzene which must be reduced in order to meet requisite fuel specifications that are commonly in the range of from about 1-3 V % benzene, with certain geographic regions targeting a benzene content of less than 1 V %. Benzene hydrogenation is an established process that can be used to reduce the benzene content of the reformate product stream.

In catalytic reforming, a naphtha stream is first hydrotreated in a hydrotreating unit to produce a hydrotreated naphtha stream. A hydrotreating unit operates according to certain conditions, including temperature, pressure, hydrogen partial pressure, liquid hourly space velocity (LHSV), and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels.

The hydrotreated naphtha stream is reformed in a reforming unit to produce a gasoline reformate product stream. In general, the operating conditions for a reforming unit include a temperature in the range of from about 260° C. to about 560° C., and in certain embodiments from about 450° C. to about 560° C.; a pressure in the range of from about 1 bar to about 50 bars, and in certain embodiments from about 1 bar to about 20 bars; and a LHSV in the range of from about 0.5 $h^{-1}$ to about 40 $h^{-1}$, and in certain embodiments from about 0.5 $h^{-1}$ to about 2 $h^{-1}$. The reformate is sent to the gasoline pool to be blended with other gasoline components to meet the required specifications.

Some gasoline blending pools include $C_4$ and heavier hydrocarbons having boiling points of less than about 205° C. In catalytic reforming process, paraffins and naphthenes are restructured to produce isomerized paraffins and aromatics of relatively higher octane numbers. Catalytic reforming converts low octane n-paraffins to i-paraffins and naphthenes. Naphthenes are converted to higher octane aromatics. The aromatics are left essentially unchanged, or some may be hydrogenated to form naphthenes due to reverse reactions taking place in the presence of hydrogen.

The reactions involved in catalytic reforming are commonly grouped into the four categories of cracking, dehydrocyclization, dehydrogenation, and isomerization. A particular hydrocarbon/naphtha feed molecule may undergo more than one category of reaction and/or may form more than one product.

The catalysts for catalytic reforming processes are either mono-functional or bi-functional reforming catalysts, which contain precious metals, such as Group VIIIB metals, as active components. A bi-functional catalyst has both metal sites and acidic sites. Refineries generally use a platinum catalyst or platinum alloy supported on alumina as the reforming catalyst. The hydrocarbon/naphtha feed composition, the impurities present therein, and the desired products will determine such process parameters as choice of catalyst(s), process type, and the like. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

There are several types of catalytic reforming process configurations which differ in the manner in which they regenerate the reforming catalyst to remove the coke formed in the reactors. Catalyst regeneration, which involves combusting detrimental coke in the presence of oxygen, includes a semi-regenerative process, cyclic regeneration, and continuous regeneration. Semi-regeneration is the simplest configuration, and the entire unit, including all reactors in the series, is shut-down for catalyst regeneration in all reactors. Cyclic configurations utilize an additional "swing" reactor to permit one reactor at a time to be taken off-line for regeneration while the others remain in service. Continuous catalyst regeneration configurations, which are the most complex, provide for essentially uninterrupted operation by catalyst removal, regeneration and replacement. While continuous catalyst regeneration configurations include the ability to increase the severity of the operating conditions due to higher catalyst activity, the associated capital investment is necessarily higher.

Reformate is usually sent to an aromatics recovery complex (ARC) where it undergoes several processing steps in order to recover high value products, for example xylenes and benzene, and to convert lower value products, for example toluene, into higher value products. For example, the aromatics present in reformate are usually separated into different fractions by carbon number; such as benzene, toluene, xylenes, and ethylbenzene, etc. The $C_8$ fraction is then subjected to a processing scheme to make more high value para-xylene. Para-xylene is usually recovered in high purity from the $C_8$ fraction by separating the para-xylene from the ortho-xylene, meta-xylene, and ethylbenzene using selective adsorption or crystallization. The ortho-xylene and meta-xylene remaining from the para-xylene separation are isomerized to produce an equilibrium mixture of xylenes. The ethylbenzene is isomerized into xylenes or is dealkylated to benzene and ethane. The para-xylene is then separated from the ortho-xylene and the meta-xylene using adsorption or crystallization and the para-xylene-deleted-stream is recycled to extinction to the isomerization unit and then to the para-xylene recovery unit until all of the ortho-xylene and meta-xylene are converted to para-xylene and recovered.

Toluene is recovered as a separate fraction, and then may be converted into higher value products, for example benzene in addition to or alternative to xylenes. One toluene conversion process involves the disproportionation of toluene to make benzene and xylenes. Another process involves the hydrodealkylation of toluene to make benzene. Both toluene disproportionation and toluene hydrodealkylation result in the formation of benzene. With the current and future anticipated environmental regulations involving benzene, it is desirable that the toluene conversion not result in the formation of significant quantities of benzene.

One problem faced by refineries is how to most economically reduce the benzene content in the reformate products sent to the gasoline pool by improving the processes and apparatus of systems described above. In some refineries, the aromatic complex bottoms are added to the gasoline fraction. However, the aromatic complex bottoms deteriorate the gasoline quality and in the long run impact the engine performance negatively.

SUMMARY

Certain embodiments of the disclosure relate to systems and processes for recovering gasoline and diesel from aromatic complex bottoms. Certain embodiments relate to catalytic reforming and aromatics recovery processes, particularly for producing benzene and xylenes. In some embodiments, an aromatics bottoms stream is directed to existing refining units. In other embodiments, a separate distillation unit is utilized to separate the aromatics bottoms stream to recover gasoline and diesel. In some embodiments, the aromatic bottoms stream from the aromatics complex is recovered and treated further to recover the hydrocarbons that boil in the gasoline and diesel boiling point range. Separated fractions have properties making them acceptable to be used in a gasoline or diesel pool.

Therefore, disclosed is a system for oil separation and upgrading, the system including: an inlet stream comprising crude oil; an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising diesel; and a naphtha hydrotreating unit (NHT), the NHT in fluid communication with the ADU and operable to treat with hydrogen the naphtha in the ADU tops stream. The system further includes a naphtha reforming unit (NREF), the NREF in fluid communication with the NHT and operable to reform a hydrotreated naphtha stream produced by the NHT, and the NREF further operable to produce separate hydrogen and reformate streams; an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream, wherein the aromatic bottoms stream is in fluid communication with the inlet stream comprising crude oil; and a diesel hydrotreating unit (DHT), the DHT in fluid communication with a diesel inlet stream, and the diesel inlet stream comprising fluid flow from the ADU middle stream.

In some embodiments, the aromatic bottoms stream comprises aromatic compounds with boiling points in a range of about 100° C. to about 350° C. In other embodiments, the benzene content of the gasoline pool stream is less than about 3% by volume. In some embodiments, the benzene content of the gasoline pool stream is less than about 1% by volume.

Additionally disclosed is a system for oil separation and upgrading, the system including: an inlet stream comprising crude oil; an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising diesel; a naphtha hydrotreating unit (NHT), the NHT in fluid communication with the ADU and operable to treat with hydrogen the naphtha in the ADU tops stream; and a naphtha reforming unit (NREF), the NREF in fluid communication with the NHT and operable to reform a hydrotreated naphtha stream produced by the NHT, and the NREF further operable to produce separate hydrogen and reformate streams. The system further includes an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream, wherein the aromatic bottoms stream is in fluid communication with the ADU middle stream comprising diesel and a diesel hydrotreating unit (DHT), the DHT in fluid communication with a diesel inlet stream, the diesel inlet stream comprising fluid flow from the ADU middle stream and the aromatic bottoms stream, and the DHT operable to treat the diesel inlet stream with hydrogen.

In some embodiments of the present disclosure, systems further comprise a secondary ADU in fluid communication with the ARC and the ADU middle stream, wherein the secondary ADU is operable to separate the aromatic bottoms stream into a gasoline stream and a stream comprising hydrocarbons boiling in a diesel-boiling-point range. In some embodiments, the aromatic bottoms stream comprises aromatic compounds with boiling points in the range of about 100° C. to about 350° C. Still in yet other embodiments, the gasoline stream is used as a gasoline blending component without any further treatment. In certain embodiments, the benzene content of the gasoline pool stream and the gasoline stream is less than about 3% by volume. In some embodiments, the benzene content of the gasoline pool stream and the gasoline stream is less than about 1% by volume.

Additionally disclosed is a system for oil separation and upgrading, the system including: an inlet stream comprising crude oil; an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising distillate; and a naphtha hydrotreating unit (NHT), the NHT in fluid communication with the ADU and operable to treat with hydrogen the naphtha in the ADU tops stream.

The system further includes a naphtha reforming unit (NREF), the NREF in fluid communication with the NHT and operable to reform a hydrotreated naphtha stream produced by the NHT, and the NREF further operable to produce separate hydrogen and reformate streams; an aromatics complex (ARC), the ARC in fluid communication with the NREF and operable to receive the reformate stream produced by the NREF, and the ARC further operable to separate the reformate stream into a gasoline pool stream, an aromatics stream, and an ARC aromatic bottoms stream; a secondary ADU in fluid communication with the ARC aromatic bottoms stream and the ADU middle stream, wherein the secondary ADU is operable to separate the aromatic bottoms stream into a gasoline stream and a stream comprising heavy aromatics; and a kerosene hydrofinishing unit (KHT), the KHT in fluid communication with a distillate inlet stream, the distillate inlet stream comprising fluid flow from the ADU middle stream and the stream comprising heavy aromatics, and the KHT operable to treat the distillate inlet stream with hydrogen.

In some embodiments, the gasoline stream is used as a gasoline blending component without any further treatment. In other embodiments, the KHT comprises a first stage sour hydrotreating section, a second stage sweet aromatic saturation and hydrocracking section with intermediate separation, and a fractionation system. Still in other embodiments, kerosene is produced and is suitable for dual purpose kerosene use according to heating and jet fuel requirements. In yet other embodiments, the aromatic bottoms stream comprises aromatic compounds with boiling points in the range of about 100° C. to about 350° C.

Additionally disclosed is a method for oil separation and upgrading, the method comprising the steps of: supplying an inlet stream comprising crude oil; separating the inlet stream into a tops stream and a middle stream, the tops stream comprising naphtha, and the middle stream comprising diesel; treating with hydrogen the naphtha in the tops stream to produce a hydrotreated naphtha stream; reforming the hydrotreated naphtha stream; producing separate hydrogen and reformate streams; separating the reformate stream into a gasoline pool stream, an aromatics stream, and an aromatic bottoms stream; and recycling the aromatic bottoms stream to the inlet stream.

In some embodiments, the method further comprises the step of treating with hydrogen the middle stream comprising diesel. Additionally disclosed is a method for oil separation and upgrading, the method comprising: supplying an inlet stream comprising crude oil; separating the inlet stream into a tops stream and a middle stream, the tops stream comprising naphtha, and the middle stream comprising diesel; treating with hydrogen the naphtha in the tops stream to produce a hydrotreated naphtha stream; reforming the hydrotreated naphtha stream; producing separate hydrogen and reformate streams; separating the reformate stream into a gasoline pool stream, an aromatics stream, and an aromatic bottoms stream; recycling the aromatic bottoms stream to the middle stream comprising diesel; and treating the middle stream comprising diesel and the aromatic bottoms stream with hydrogen.

In some embodiments, the method further comprises the step of separating the aromatic bottoms stream into a gasoline stream and a stream comprising hydrocarbons boiling in a diesel-boiling-point range before treating the middle stream comprising diesel and the aromatic bottoms stream with hydrogen. Still further disclosed is a method for oil separation and upgrading, the method comprising the steps of: supplying an inlet stream comprising crude oil; separating the inlet stream into a tops stream and a middle stream, the tops stream comprising naphtha, and the middle stream comprising distillate; treating with hydrogen the naphtha in the tops stream to produce a hydrotreated naphtha stream; reforming the hydrotreated naphtha stream to produce separate hydrogen and reformate streams; separating the reformate stream into a gasoline pool stream, an aromatics stream, and an aromatic bottoms stream; separating the aromatic bottoms stream into a gasoline stream and a stream comprising heavy aromatics; combining the middle stream comprising distillate and the stream comprising heavy aromatics; and treating the middle stream comprising distillate and the stream comprising heavy aromatics with hydrogen.

Additionally disclosed is a system for oil separation and upgrading, the system comprising: an inlet stream comprising crude oil; an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising distillate; and a naphtha hydrotreating unit (NHT), the NHT in fluid communication with the ADU and operable to treat with hydrogen the naphtha in the ADU tops stream.

The system further includes a naphtha reforming unit (NREF), the NREF in fluid communication with the NHT and operable to reform a hydrotreated naphtha stream produced by the NHT, and the NREF further operable to produce separate hydrogen and reformate streams; an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream, wherein the aromatic bottoms stream is in fluid communication with the inlet stream comprising crude oil; and a kerosene hydrofinishing unit (KHT), the KHT in fluid communication with a distillate inlet stream, the distillate inlet stream comprising fluid flow from the ADU middle stream and comprising heavy aromatics from the aromatic bottoms stream, and the KHT operable to treat the distillate inlet stream with hydrogen.

Further disclosed is a method for oil separation and upgrading, the method comprising the steps of: supplying an inlet stream comprising crude oil; separating the inlet stream into a tops stream and a middle stream, the tops stream comprising naphtha, and the middle stream comprising distillate; treating with hydrogen the naphtha in the tops stream to produce a hydrotreated naphtha stream; reforming the hydrotreated naphtha stream to produce separate hydrogen and reformate streams; separating the reformate stream into a gasoline pool stream, an aromatics stream, and an aromatic bottoms stream; and recycling the aromatic bottoms stream to the inlet stream. In some embodiments, the method further comprises the step of treating with hydrogen the middle stream comprising distillate.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems and methods for gasoline and diesel recovery from aromatic complex bottoms, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1A:
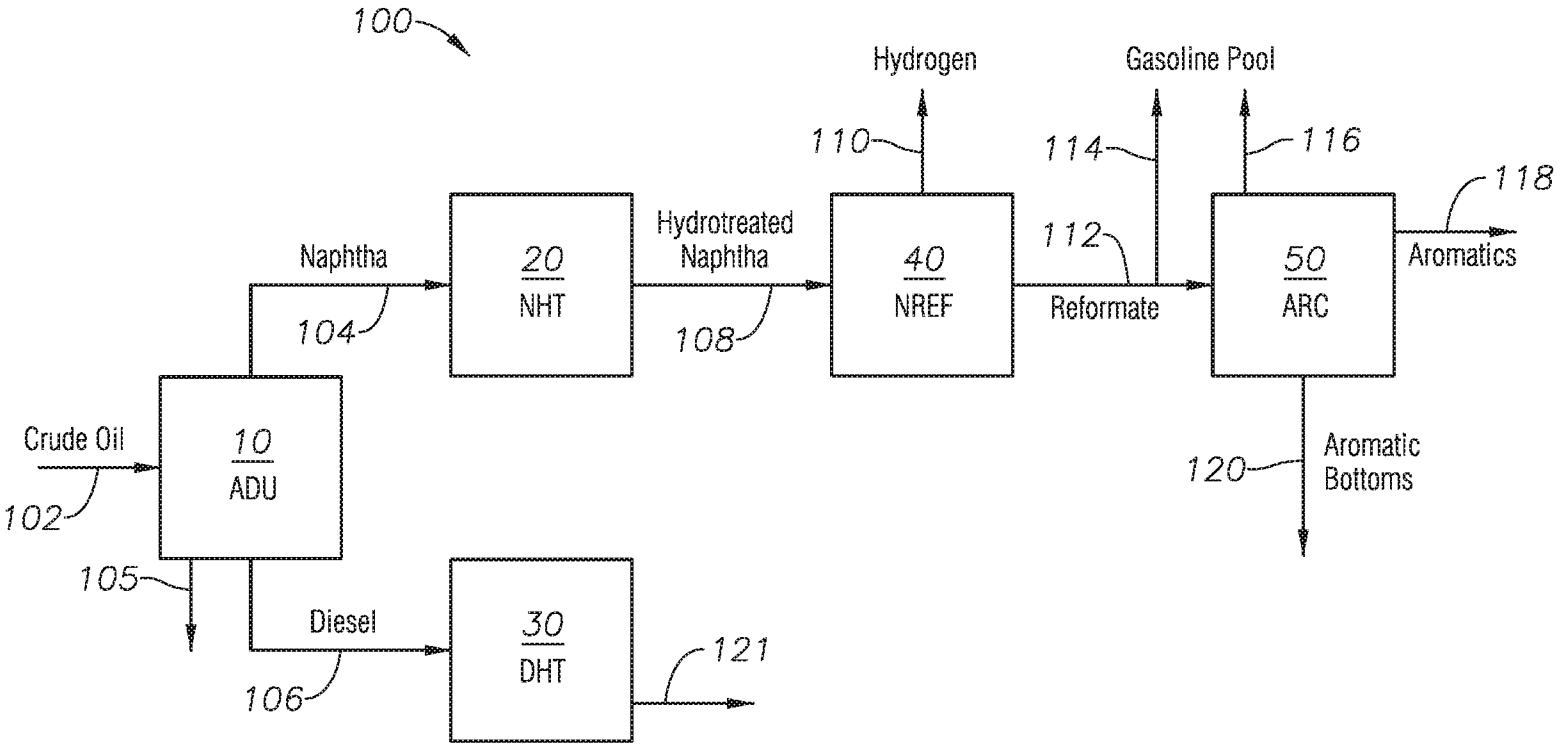
FIG. 1A (Prior Art)
FIG. 1A is a schematic of a conventional system for gasoline and aromatic production.

Referring first to FIG. 1A, a schematic of a conventional system for gasoline and aromatic production is shown. In the embodiment of FIG. 1A, a refinery with an aromatic complex is presented. In refining system 100, a crude oil inlet stream 102 is fluidly coupled to atmospheric distillation unit (ADU) 10, and crude oil from the crude oil inlet stream 102 is separated into naphtha stream 104, atmospheric residue stream 105, and diesel stream 106. Diesel stream 106 proceeds to diesel hydrotreating unit (DHT) 30, and naphtha stream 104 proceeds to naphtha hydrotreating unit (NHT) 20. A hydrotreated naphtha stream 108 exits NHT 20 and enters catalytic naphtha reforming unit (NREF) 40. A separated hydrogen stream 110 exits NREF 40, and a reformate stream 112 also exits NREF 40. A portion of reformate stream 112 enters aromatic complex (ARC) 50, and another portion of reformate stream 112 is separated by pool stream 114 to a gasoline pool. ARC 50 separates the reformate from reformate stream 112 into pool stream 116, aromatics stream 118, and aromatic bottoms 120.

The crude oil is distilled in ADU 10 to recover naphtha, which boils in the range of about 36° C. to about 180° C., and diesel, which boils in the range of about 180° C. to about 370° C. An atmospheric residue fraction in atmospheric residue stream 105 boils at about 370° C. and higher. Naphtha stream 104 is hydrotreated in NHT 20 to reduce the sulfur and nitrogen content to less than about 0.5 ppmw, and the hydrotreated naphtha stream 108 is sent to NREF 40 to improve its quality, or in other words increase the octane number to produce gasoline blending stream or feedstock for an aromatics recovery unit. Diesel stream 106 is hydrotreated in DHT 30 to desulfurize the diesel oil to obtain a diesel fraction meeting stringent specifications at ultra-low sulfur diesel (ULSD) stream 121, such as, for example, less than 10 ppm sulfur. An atmospheric residue fraction is either used as a fuel oil component or sent to other separation or conversion units to convert low value hydrocarbons to high value products. Reformate stream 112 from NREF 40 can be used as a gasoline blending component or sent to an aromatic complex, such as ARC 50, to recover high value aromatics, such as benzene, toluene and xylenes.

Figure 1B:
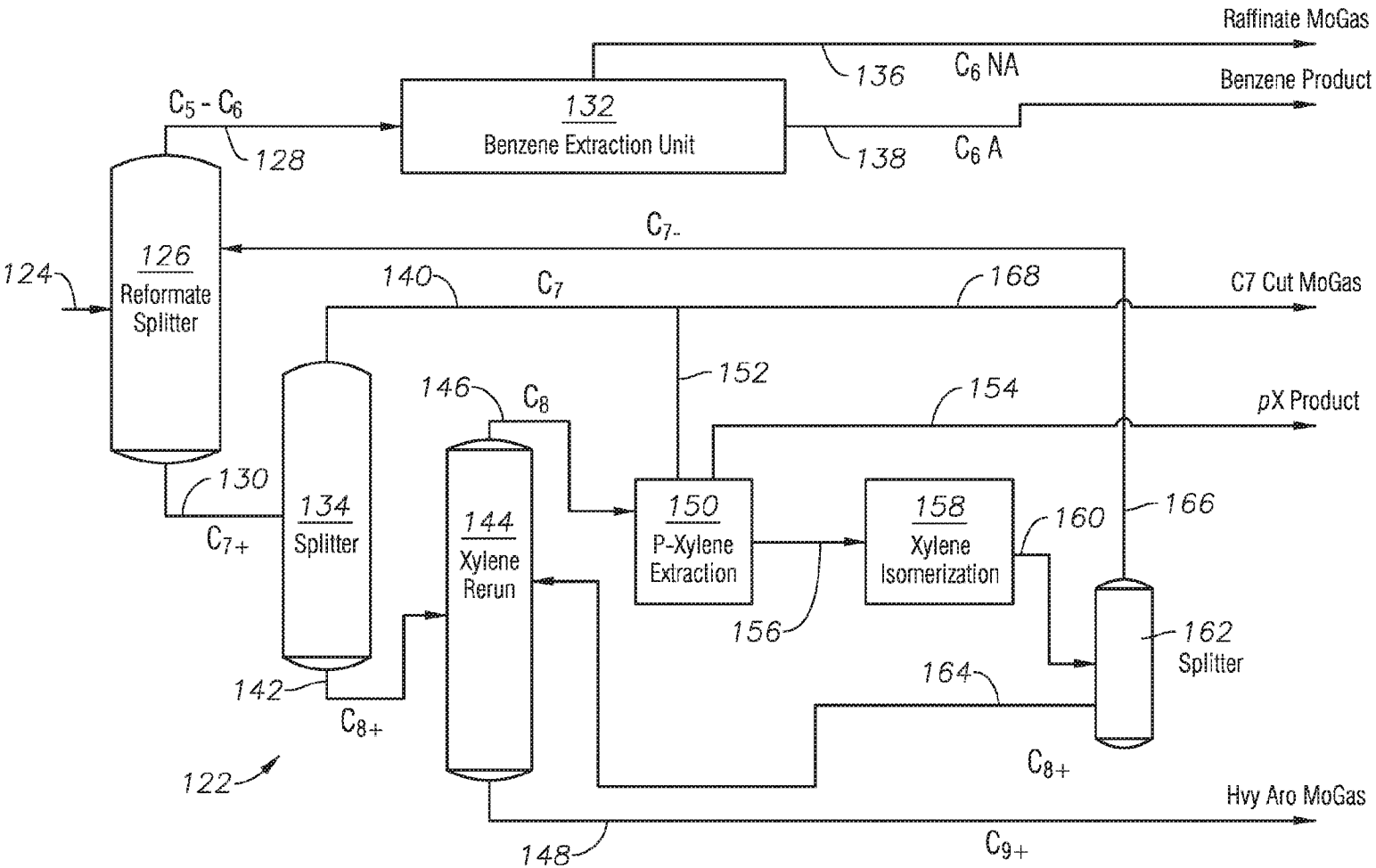
FIG. 1B (Prior Art)
FIG. 1B is a schematic of a conventional aromatics separation complex.

Referring now to FIG. 1B, a schematic of a prior art aromatics separation complex 122, such as, for example, ARC 50 of FIG. 1, is shown. Reformate stream 124 from a catalytic reforming unit, such as, for example, NREF 40 of FIG. 1, is split into two fractions: light reformate stream 128 with $C_5$-$C_6$ hydrocarbons, and heavy reformate stream 130 with $C_{7+}$ hydrocarbons. A reformate splitter 126 separates reformate stream 124. The light reformate stream 128 is sent to a benzene extraction unit 132 to extract the benzene as benzene product in stream 138, and to recover substantially benzene-free gasoline in raffinate motor gasoline (mogas) stream 136. The heavy reformate stream 130 is sent to a splitter 134 which produces a $C_7$ cut mogas stream 140 and a $C_{8+}$ hydrocarbon stream 142.

Still referring to FIG. 1B, a xylene rerun unit 144 separates $C_{8+}$ hydrocarbons into $C_8$ hydrocarbon stream 146 and $C_{9+}$ (heavy aromatic mogas) hydrocarbon stream 148. $C_8$ hydrocarbon stream 146 proceeds to p-xylene extraction unit 150 to recover p-xylene in p-xylene product stream 154. P-xylene extraction unit 150 also produces a $C_7$ cut mogas stream 152, which combines with $C_7$ cut mogas stream 140 to produce $C_7$ cut mogas stream 168. Other xylenes are recovered and sent to xylene isomerization unit 158 by stream 156 to convert them to p-xylene. The isomerized xylenes are sent to splitter column 162. The converted fraction is recycled back to p-xylene extraction unit 150 from splitter column 162 by way of streams 164 and 146.

Splitter top stream 166 is recycled back to reformate splitter 126. The heavy fraction from the xylene rerun unit 144 is recovered as process reject or aromatic bottoms (shown as $C_{9+}$ and Hvy Aro MoGas in FIG. 1B at stream 148).

Figure 2:
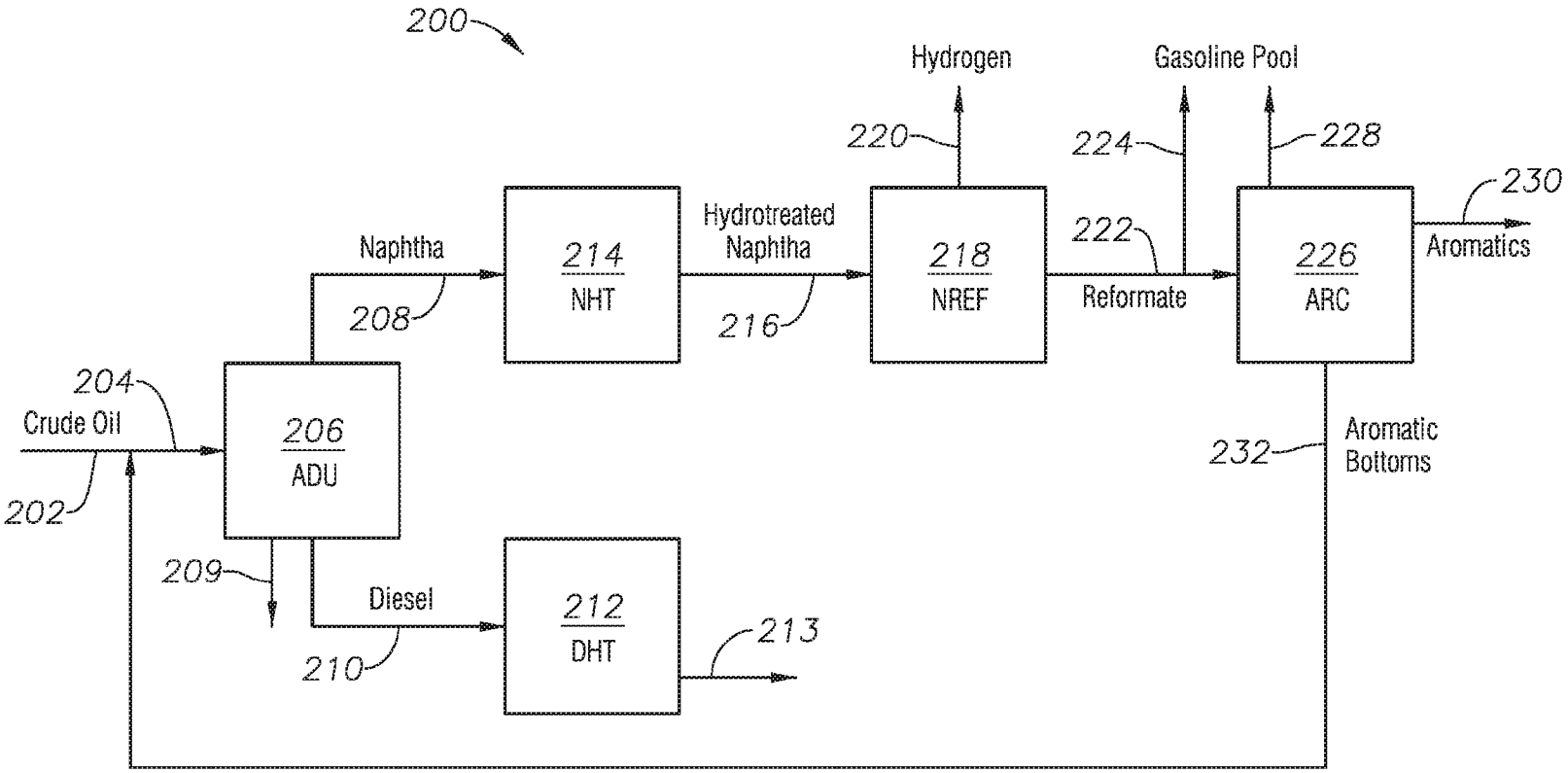
FIG. 2 is a schematic of an embodiment of the present disclosure, in which aromatic bottoms are recycled back to a crude oil distillation unit for diesel hydrotreating.

Referring now to FIG. 2, a schematic is shown of an embodiment of the present disclosure, in which aromatic bottoms are recycled back to a crude oil distillation unit. In crude oil separation and upgrading system 200, crude oil stream 202 is combined with aromatic bottoms stream 232 to form hydrocarbon feed stream 204, which feeds ADU 206. ADU 206 separates hydrocarbons from hydrocarbon feed stream 204 into naphtha stream 208, atmospheric residue stream 209, and diesel stream 210. Diesel stream 210 is fed to DHT 212 for processing to produce ULSD stream 213. Naphtha stream 208 is fed to NHT 214 for processing. A hydrotreated naphtha stream 216 is fed to NREF 218. NREF 218 produces a hydrogen stream 220 and a reformate stream 222. A portion of reformate stream 222 proceeds to a gasoline pool by way of stream 224, and a portion of reformate stream 222 is fed to ARC 226. ARC 226 produces aromatics, for example benzene and xylenes, at stream 230 and aromatic bottoms at stream 232. A portion of hydrocarbons from ARC 226 goes to the gasoline pool by way of stream 228.

As described herein, the term "aromatics" includes $C_6$-$C_8$ aromatics, such as for example benzene and xylenes, for example streams 138, 154 in FIG. 1B, whereas "aromatic bottoms" include the heavier fraction, for example stream 148 in FIG. 1B ($C_{9+}$). Aromatic bottoms relate to $C_{9+}$ aromatics and may be a more complex mixture of compounds including di-aromatics. $C_{9+}$ aromatics boil in the range of about 100° C. to about 350° C.

Aromatics bottoms at stream 232 are recycled to the ADU 206 for full extinction. Hydrocarbons boiling in the naphtha and diesel temperature range from the aromatic bottoms stream 232 and also from the crude oil stream 202 are recovered and processed in the processing units. Recycled aromatics bottoms at stream 232 will not substantially change the operating conditions, as the stream 232 is in the naphtha and gasoline boiling range. The liquid hourly space velocity ("LHSV") may be impacted, as there will be increased feed to the respective naphtha and diesel units.

Figure 3:
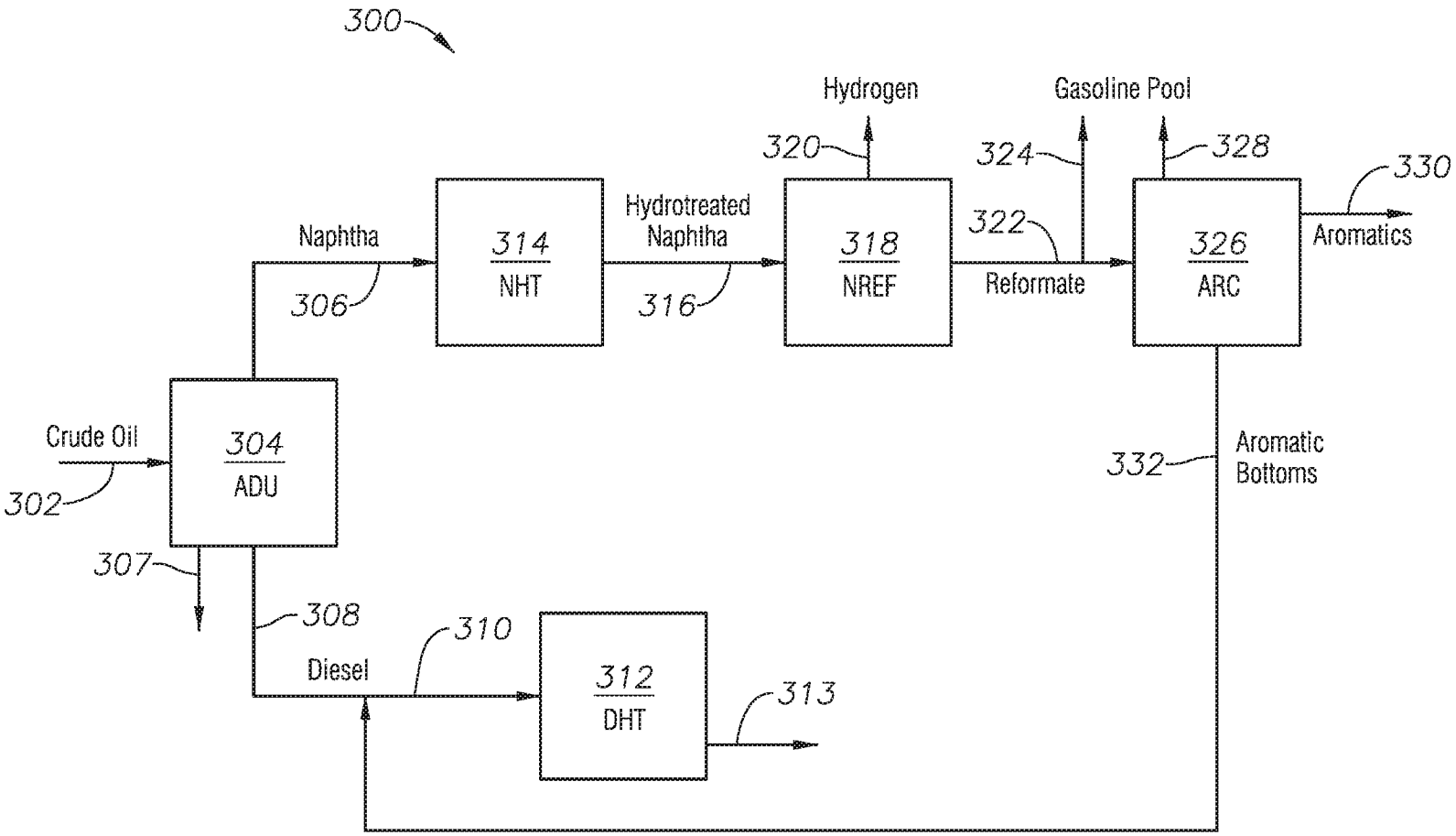
FIG. 3 is a schematic of an embodiment of the present disclosure, in which aromatic bottoms are recycled back to a diesel hydrotreating unit.

Referring now to FIG. 3, a schematic is shown of an embodiment of the present disclosure, in which aromatic bottoms are recycled back to a diesel hydrotreating unit. In crude oil separation and upgrading system 300, crude oil stream 302 feeds ADU 304, which separates crude oil into naphtha stream 306, atmospheric residue stream 307, and diesel stream 308. Diesel stream 308 is combined with aromatic bottoms stream 332 to produce a diesel feed stream 310 to feed DHT 312 and produce ULSD stream 313. Naphtha stream 306 is fed to NHT 314 for processing. A hydrotreated naphtha stream 316 is fed to NREF 318. NREF 318 produces a hydrogen stream 320 and a reformate stream 322. A portion of reformate stream 322 proceeds to a gasoline pool by way of stream 324, and a portion of reformate stream 322 is fed to ARC 326. ARC 326 produces aromatics at stream 330 and aromatic bottoms at stream 332. The aromatic bottoms stream 332 is recycled to DHT 312 for full extinction. Aromatic bottoms are processed in the diesel hydrotreating unit 312 to increase the quality to be used as gasoline or diesel blending components. A portion of hydrocarbons from ARC 326 goes to the gasoline pool by way of stream 328.

Figure 4:
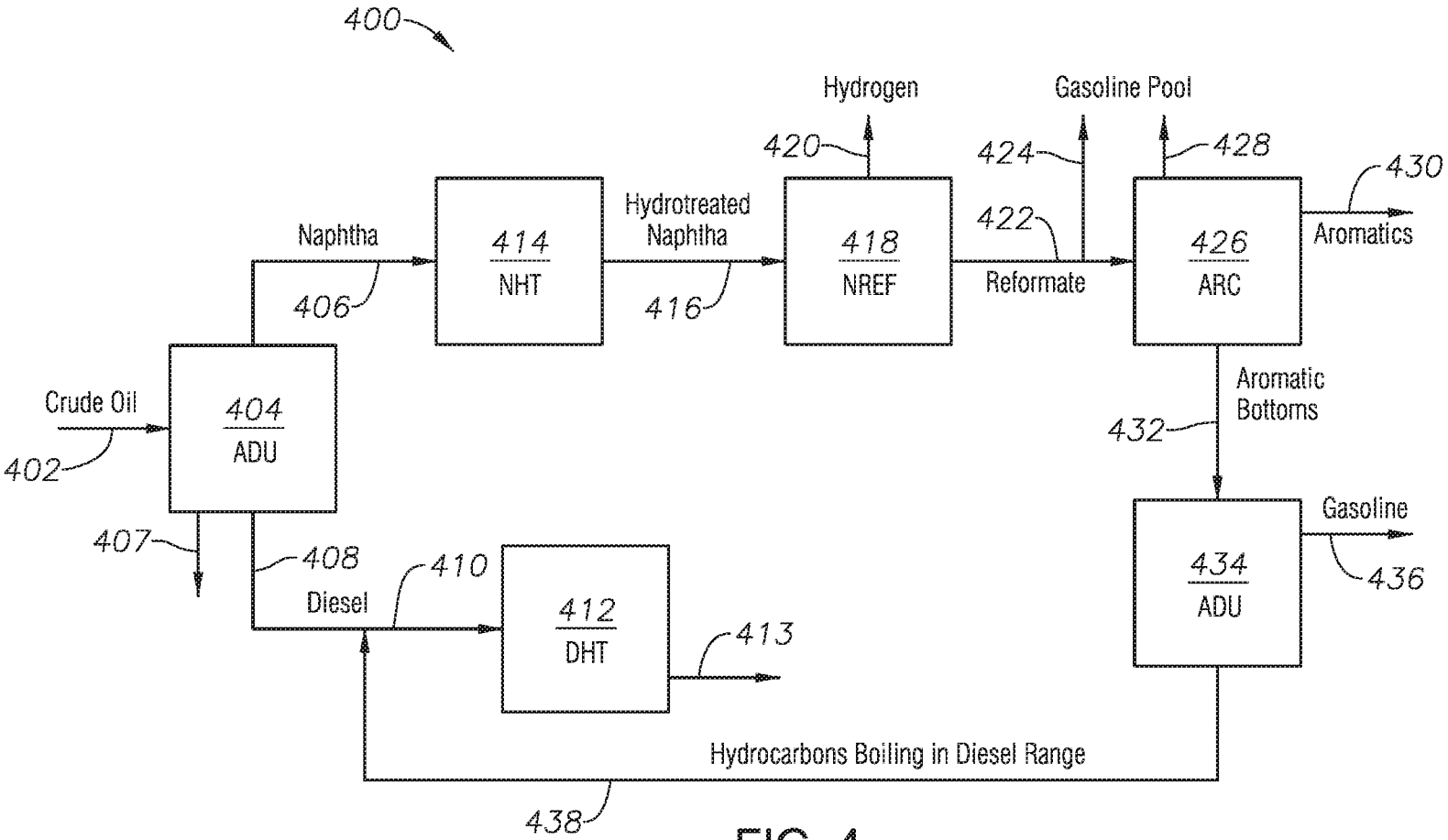
FIG. 4 is a schematic of an embodiment of the present disclosure, in which aromatic bottoms are separated in a distillation column, where the fraction boiling within the diesel range is recycled back to a diesel hydrotreating unit.

Referring now to FIG. 4, a schematic is shown of an embodiment of the present disclosure, in which aromatic bottoms are separated in a distillation column and the fraction boiling within the diesel range is recycled back to a diesel hydrotreating unit. In crude oil separation and upgrading system 400, crude oil stream 402 feeds ADU 404, which separates crude oil into naphtha stream 406, atmospheric residue stream 407, and diesel stream 408. Diesel stream 408 is combined with a stream of hydrocarbons boiling in the diesel range, diesel range stream 438, to produce a diesel feed stream 410 to feed DHT 412 and produce ULSD stream 413. Naphtha stream 406 is fed to NHT 414 for processing. A hydrotreated naphtha stream 416 is fed to NREF 418. NREF 418 produces a hydrogen stream 420 and a reformate stream 422. A portion of reformate stream 422 goes to a gasoline pool by way of stream 424, and a portion of reformate stream 422 is fed to ARC 426.

ARC 426 produces aromatics at stream 430 and aromatic bottoms at stream 432. A portion of hydrocarbons from ARC 426 goes to the gasoline pool by way of stream 428. The aromatic bottoms stream 432 is sent to ADU 434 to produce a gasoline stream 436 and the hydrocarbons boiling in diesel range stream 438. Aromatic bottoms are processed in the diesel hydrotreating unit 412 to increase the quality to be used as gasoline or diesel blending components. Gasoline stream 436 includes tops, such as hydrocarbons boiling in the naphtha/gasoline range. Gasoline stream 436 has a good quality and can be used as a blending component without any further treatment. As noted, hydrocarbons boiling in diesel range stream 438 are recycled to DHT 412 to improve quality and to be used as a blending component.

Figure 5:
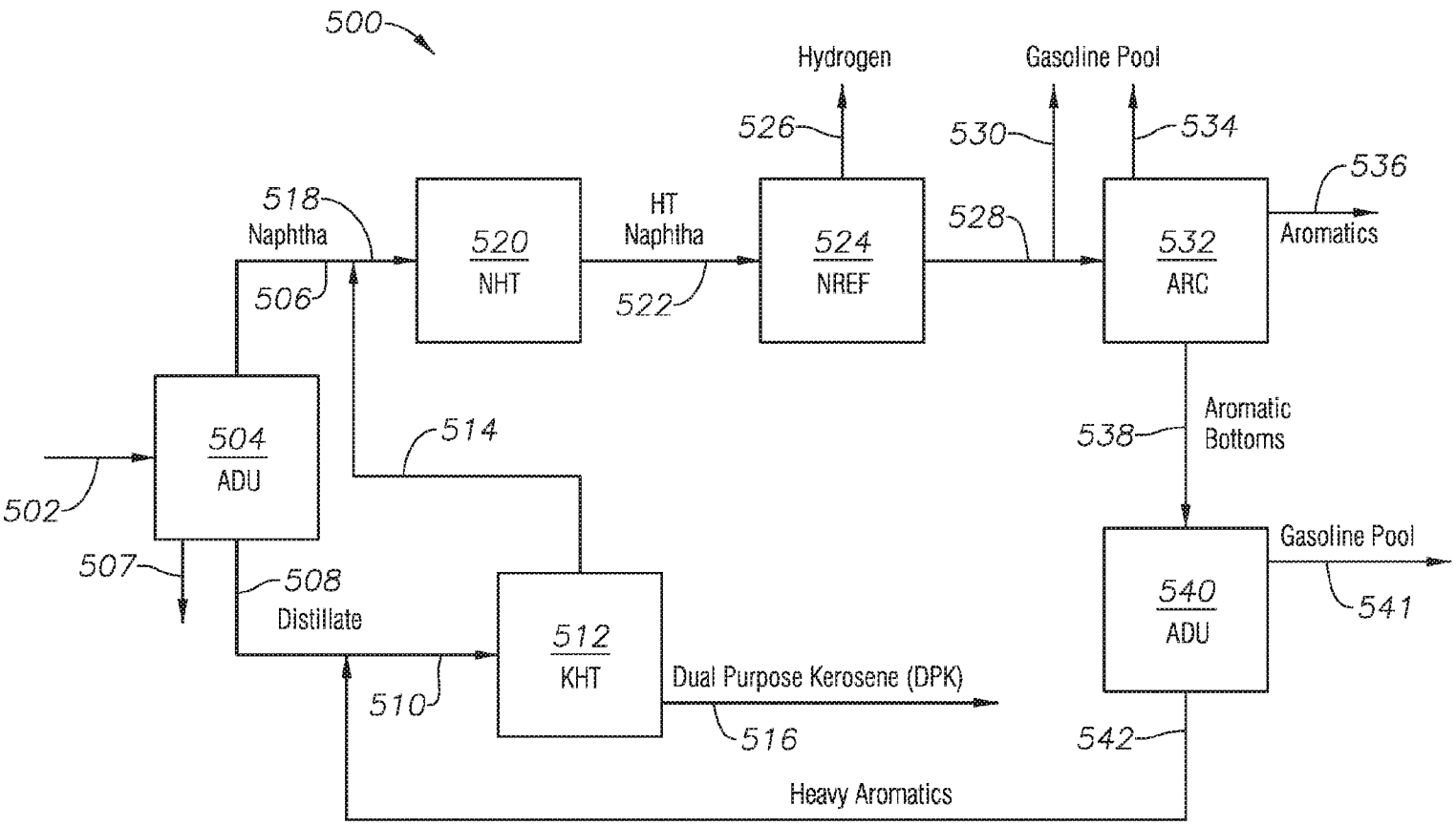
FIG. 5 is a schematic of an embodiment of the present disclosure, in which aromatic bottoms are separated in a distillation column, where the fraction boiling within the distillate range is recycled back to a kerosene hydrofinishing unit.

Referring now to FIG. 5, a schematic is shown of an embodiment of the present disclosure, in which aromatic bottoms are separated in a distillation column and the fraction boiling within the distillate range is recycled back to a kerosene hydrofinishing unit. In crude oil separation and upgrading system 500, Crude oil stream 502 feeds ADU 504, which separates crude oil into naphtha stream 506, atmospheric residue stream 507, and distillate stream 508. Naphtha from stream 506 and stream 514 are combined to form naphtha feed 518 for NHT 520. Distillate stream 508 is combined with heavy aromatics stream 542 to produce a distillate feed stream 510 to feed kerosene hydrofinishing unit (KHT) 512. A hydrotreated naphtha stream 522 is fed to NREF 524. NREF 524 produces a hydrogen stream 526 and a reformate stream 528. A portion of reformate stream 528 goes to a gasoline pool by way of stream 530, and a portion of reformate stream 528 is fed to ARC 532.

ARC 532 produces aromatics at stream 536 and aromatic bottoms at stream 538. A portion of hydrocarbons from ARC 532 goes to the gasoline pool by way of stream 534. The aromatic bottoms stream 538 is sent to ADU 540 to produce a gasoline stream 541 and the heavy aromatics stream 542. Heavy aromatics stream 542 is processed in KHT 512 to increase the quality to be used as gasoline or diesel blending components. Gasoline stream 541 has a good quality and can be used as a blending component without any further treatment.

KHT 512 includes a hydrotreating section and a cracking section with intermediate separation and a fractionation system. The first stage is a sour hydrotreating stage for processing distillate from the ADU 504. Stripped effluent is then mixed with heavy aromatics and is sent to a second stage which includes a sweet hydroprocessing stage including noble metal catalyst-based aromatic saturation and hydrocracking.

One objective in KHT 512 is to produce kerosene that is essentially very low in aromatics and high in smoke point, which can be used as dual purpose kerosene for both heating and jet fuel requirements, the dual purpose kerosene exiting as stream 516. Operating Conditions of the first stage are similar to a conventional ultra-low sulfur diesel (ULSD) hydrotreating unit, while the sweet second stage would be combined with aromatic saturation kerosene hydrotreating (first stage LHSV 1-5 $h^{-1}$; and a cracking section LHSV of 3-8 $h^{-1}$). The system pressure, in some embodiments, is governed by the aromatic saturation requirement, or in other words the smoke point of kerosene as opposed to the hydrodesulfurization (HDS) requirement for ULSD.

Figure 6:
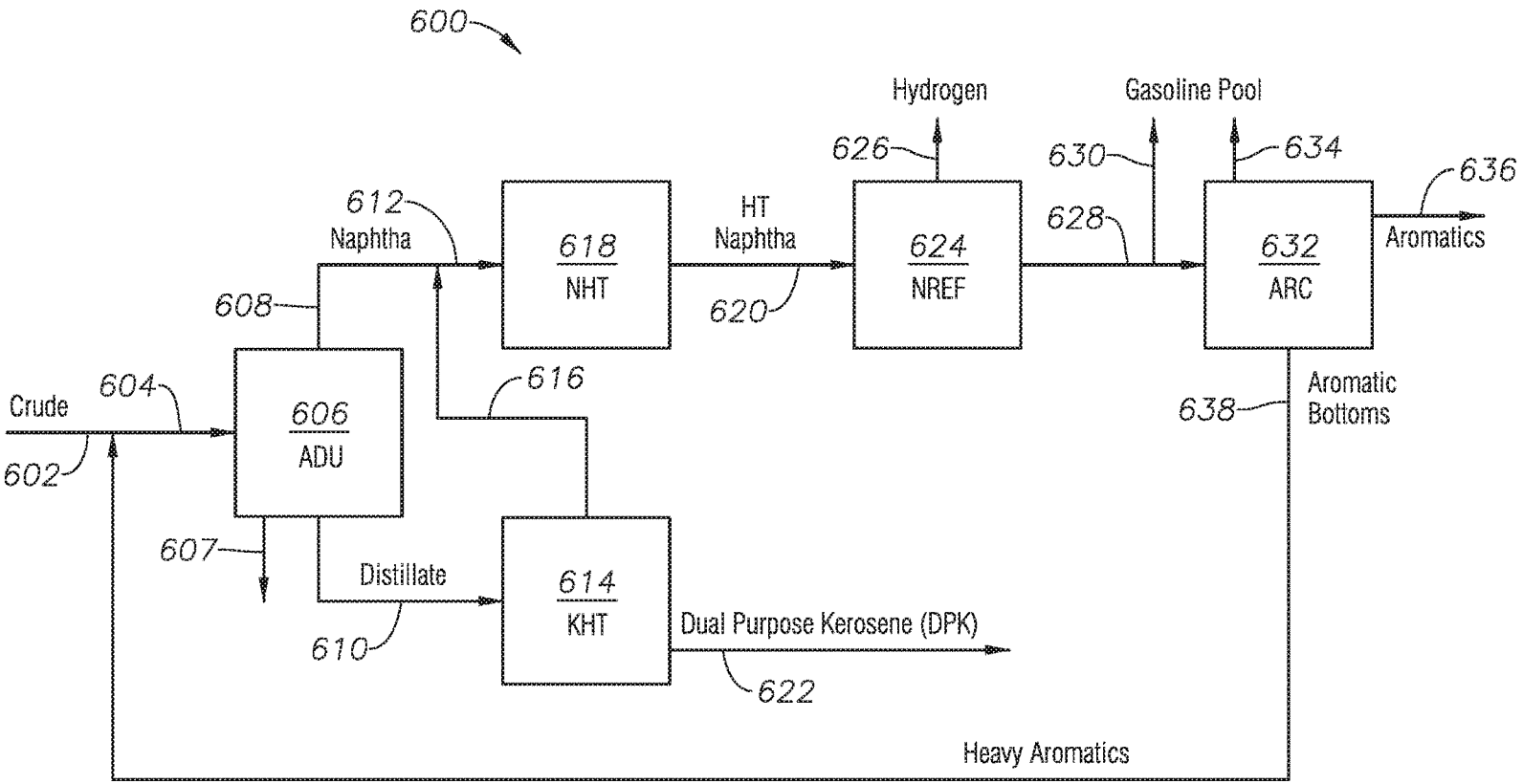
FIG. 6 is a schematic of an embodiment of the present disclosure, in which aromatic bottoms are recycled back to a crude oil distillation column for kerosene hydrofinishing.

Referring now to FIG. 6, a schematic is shown of an embodiment of the present disclosure, in which aromatic bottoms are recycled back to a crude oil distillation unit. In crude oil separation and upgrading system 600, crude oil stream 602 is combined with aromatic bottoms stream 638 to form hydrocarbon feed stream 604, which feeds ADU 606. ADU 606 separates hydrocarbons from hydrocarbon feed stream 604 into atmospheric residue stream 607, naphtha stream 608, and distillate stream 610. Naphtha from stream 608 and stream 616 are combined to form naphtha feed 612 for NHT 618. Distillate stream 610 is fed to a kerosene hydrofinishing unit (KHT) 614. A hydrotreated naphtha stream 620 is fed to NREF 624. NREF 624 produces a hydrogen stream 626 and a reformate stream 628. A portion of reformate stream 628 goes to a gasoline pool by way of stream 630, and a portion of reformate stream 628 is fed to ARC 632.

ARC 632 produces aromatics at stream 636 and aromatic bottoms at stream 638. A portion of hydrocarbons from ARC 632 goes to the gasoline pool by way of stream 634. The aromatic bottoms stream 638 is recycled to the ADU 606 for full extinction. Hydrocarbons boiling in the naphtha and distillate temperature range from the aromatic bottoms stream 638 and also from crude oil stream 602 are recovered and processed in the processing units. The distillate stream 610 is processed in KHT 614 to increase the quality to be used as gasoline or diesel blending components.

KHT 614 includes a hydrotreating and a cracking section in a series flow with intermediate separation followed by a fractionation system. The kerosene produced is essentially very low in aromatics and high in smoke point and can be used as dual purpose kerosene for both heating and jet fuel requirements, the dual purpose kerosene exiting as stream 622.

Example 1

The system depicted in FIG. 4 is illustrated in this example. 5.514 kg of aromatics bottoms fraction is distilled in lab scale true boiling point distillation columns with 15 or more theoretical plates using ASTM method D2892. 3.109 Kg (56.5 W %) of gasoline fraction boiling in the range of about 36° C. to about 180° C. and 2.396 Kg (43.5 W %) of residue stream boiling above 180° C. were recovered. The gasoline fraction was analyzed for its content and octane numbers.

TABLE 1

Properties and composition of all streams from Example 1. In the tables, "NAP" refers to not applicable.

| Property | Feedstock Aromatic Bottoms | Tops Gasoline Initial Boiling Point (IBP) - 180° C. | Bottoms Diesel 180+° C. |
|---|---|---|---|
| Density | 0.913 | 0.873 | 0.9226 |
| Octane Number ASTM D2699 | NAP | 107 | NAP |

TABLE 1-continued

Properties and composition of all streams from Example 1. In the tables, "NAP" refers to not applicable.

| Property | Feedstock Aromatic Bottoms | Tops Gasoline Initial Boiling Point (IBP) - 180° C. | Bottoms Diesel 180+° C. |
|---|---|---|---|
| Cetane Index ASTM D976 | | NAP | 16 |
| IBP | 21 | 153 | 163 |
| 5 W % | 36 | 161 | 178 |
| 10 W % | 34 | 162 | 167 |
| 30 W % | 58 | 163 | 196 |
| 50 W % | 98 | 169 | 221 |
| 70 W % | 138 | 171 | 258 |
| 90 W % | 168 | 184 | 336 |
| 95 W % | 181 | 184 | 338 |
| FBP | 207 | 251 | 351 |
| Paraffins | 0.17 | | |
| Mono Aromatics | 74.60 | | |
| Naphthene Mono Aromatics | 3.06 | | |
| Diaromatics | 15.36 | | |
| Naphthene Di Aromatics | 5.21 | | |
| Tri Aromatics | 0.59 | | |
| Naphthene tri Aromatics | 0.78 | | |
| Tetra Aromatics | 0.18 | | |
| Naphthene tetra Aromatics | 0.15 | | |
| Penta Aromatics | 0.42 | | |

TABLE 2

Paraffins, isoparaffins, olefins, naphthenes, and aromatics (PIONA) of Gasoline Fraction (IMP - 180° C.).

| Fraction | Component | W % |
|---|---|---|
| i-paraffins | 3,3-Dimethylhexane | 0.169 |
| Mono-Aromatics | i-Propylbenzene | 0.794 |
| | n-Propylbenzene | 4.377 |
| | 1-Methyl-3-ethylbenzene | 16.816 |
| | 1-Methyl-4-ethylbenzene | 7.729 |
| | 1,3,5-Trimethylbenzene | 6.460 |
| | 1-Methyl-2-ethylbenzene | 7.484 |
| | 1,2,4-Trimethylbenzene | 28.890 |
| | i-Butylbenzene | 0.093 |
| | sec-Butylbenzene | 0.108 |
| | 1,2,3-Trimethylbenzene | 6.294 |
| | 1-Methyl-3-i-propylbenzene | 0.397 |
| | 1-Methyl-4-i-propylbenzene | 0.124 |
| | 1,3-Diethylbenzene | 0.392 |
| | 1-Methyl-3-n-propylbenzene | 0.705 |
| | 1-Methyl-4-n-propylbenzene | 15.725 |
| | 1,3-Dimethyl-5-ethylbenzene | 0.749 |
| | 1-Methyl-2-n-propylbenzene | 0.210 |
| | 1,4,Dimethyl-2-ethylbenzene | 0.457 |
| | 1,3-Dimethyl-4-ethylbenzene | 0.341 |
| | 1,2-Dimethyl-4-ethylbenzene | 0.666 |
| | 1-Ethyl-4-i-propylbenzene | 0.106 |
| | 1-Methyl-1-n-butylbenzene | 0.082 |
| Lndenes | 2,3-Dihydroindene | 0.831 |

Surprisingly and unexpectedly, gasoline obtained from the aromatic bottoms is a good quality. In other words, the gasoline initial boiling point (IBP)—180° C. fraction has an octane number sufficiently high to be directed to the gasoline pool without further processing. However, in some embodiments, the diesel cetane index is very low. The diesel cetane index may increase marginally. However, considering its amount, it may not deteriorate the diesel quality, where high quality gas oils such as Arabian are processed.

The singular forms "a," "an," and "the" include plural referents, unless the context clearly dictates otherwise.

One of ordinary skill in the art will understand that standard components such as pumps, compressors, temperature and pressure sensors, valves, and other components not shown in the drawings would be used in applications of the systems and methods of the present disclosure.

In the drawings and specification, there have been disclosed example embodiments of the present disclosure, and although specific terms are employed, the terms are used in a descriptive sense only and not for purposes of limitation. The embodiments of the present disclosure have been described in considerable detail with specific reference to these illustrated embodiments. It will be apparent, however, that various modifications and changes can be made within the spirit and scope of the disclosure as described in the foregoing specification, and such modifications and changes are to be considered equivalents and part of this disclosure.

What is claimed is:

1. A system for oil separation and upgrading, the system comprising:

an inlet stream comprising crude oil;

an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising diesel;

a naphtha hydrotreating unit (NHT), the NHT in fluid communication with the ADU and operable to treat with hydrogen the naphtha in the ADU tops stream;

a naphtha reforming unit (NREF), the NREF in fluid communication with the NHT and operable to reform a hydrotreated naphtha stream produced by the NHT, and the NREF further operable to produce separate hydrogen and reformate streams;

an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream, wherein the aromatic bottoms stream is in fluid communication with the ADU middle stream comprising diesel; and a diesel hydrotreating unit (DHT), the DHT in fluid communication with a diesel inlet stream, the diesel inlet stream comprising fluid flow from the ADU middle stream and the aromatic bottoms stream, and the DHT operable to treat the diesel inlet stream with hydrogen.

2. The system according to claim 1, wherein the system further comprises a secondary ADU in fluid communication with the ARC and the ADU middle stream, wherein the secondary ADU is operable to separate the aromatic bottoms stream into a gasoline stream and a stream comprising hydrocarbons boiling in a diesel-boiling-point range.

3. The system according to claim 1, wherein the aromatic bottoms stream comprises aromatic compounds with boiling points in the range of about 100° C. to about 350° C.

4. The system according to claim 2, wherein the gasoline stream is used as a gasoline blending component without any further treatment.

5. The system according to claim 2, wherein benzene content of the gasoline pool stream and the gasoline stream is less than about 3% by volume.

6. The system according to claim 2, wherein benzene content of the gasoline pool stream and the gasoline stream is less than about 1% by volume.

7. A method for oil separation and upgrading, the method comprising:

supplying an inlet stream comprising crude oil;

separating the inlet stream into a tops stream and a middle stream, the tops stream comprising naphtha, and the middle stream comprising diesel;

treating with hydrogen the naphtha in the tops stream to produce a hydrotreated naphtha stream;

reforming the hydrotreated naphtha stream;

producing separate hydrogen and reformate streams;

separating the reformate stream into a gasoline pool stream, an aromatics stream, and an aromatic bottoms stream;

recycling the aromatic bottoms stream to the middle stream comprising diesel; and treating the middle stream comprising diesel and the aromatic bottoms stream with hydrogen.

8. The method according to claim 7, further comprising the step of separating the aromatic bottoms stream into a gasoline stream and a stream comprising hydrocarbons boiling in a diesel-boiling-point range before treating the middle stream comprising diesel and the aromatic bottoms stream with hydrogen.

* * * * *